United States Patent [19]

dasa

[11] Patent Number: 4,957,465

[45] Date of Patent: Sep. 18, 1990

[54] MODEL AIRPLANE OR TOY GLIDER

[76] Inventor: Madhava dasa, P.O. Box 461, Kula, Hi. 96790-0461

[21] Appl. No.: 179,231

[22] Filed: Apr. 8, 1988

[51] Int. Cl.[5] ..... A63H 27/18

[52] U.S. Cl. ..... 446/61; 446/66; 446/68

[58] Field of Search ..... 446/93, 61, 63–68

[56] References Cited

U.S. PATENT DOCUMENTS

| | | | |
|---|---|---|---|
| 1,792,779 | 2/1931 | Tarr | 446/66 |
| 2,739,414 | 3/1956 | Cleveland | 446/66 |
| 2,867,941 | 1/1959 | Du Breuil | 446/68 X |
| 3,553,884 | 1/1971 | Dunstan . | |
| 3,714,734 | 2/1973 | Livingston | 446/67 |
| 3,729,862 | 5/1973 | Halsey | 446/68 X |
| 3,733,737 | 5/1973 | Goodman | 446/68 |
| 3,778,926 | 12/1973 | Gladych | 446/66 |

FOREIGN PATENT DOCUMENTS

| | | | |
|---|---|---|---|
| 416085 | 11/1946 | Italy | 446/64 |
| 551375 | 2/1943 | United Kingdom | 446/67 |
| 1220055 | 1/1971 | United Kingdom | 446/61 |

*Primary Examiner*—Mickey Yu

[57] ABSTRACT

A model airplane or toy glider resembling a natural creature or of other design at least partially constructed of semi-rigid scoreable and foldable material such as polystyrene foam sheet, may contain one or more scored foldlines, the fold angle of the scored foldlines being aligned by angle setting members in specified relationship. A fuselage may be constructed having forward peninsulalike parts formed by a slot extending rearward from the front of the fuselage, the peninsulalike fuselage parts interlocking with a slotted wing and held together by an appropriately shaped nose weight. A fuselage may include a hoodlike part or may be of a specified complex three dimensional structure. A wing may have a central rearwardly extending portion, the portion having a pair of diagonally hinged control surfaces radiating from the central rearwardmost point.

4 Claims, 6 Drawing Sheets

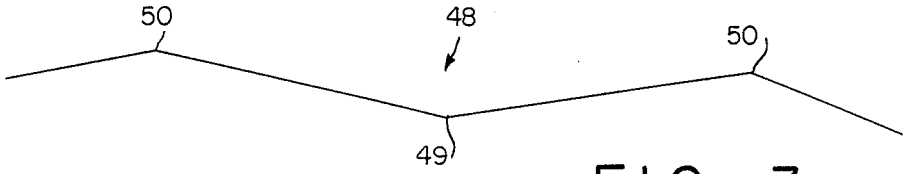
FIG. 3
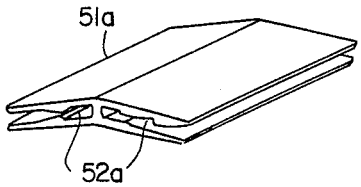
FIG. 4
FIG. 5
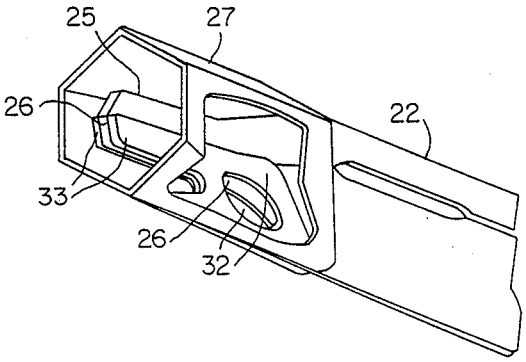
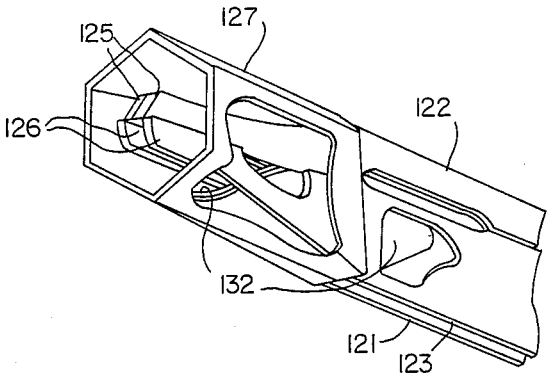
FIG. 6

FIG. 7
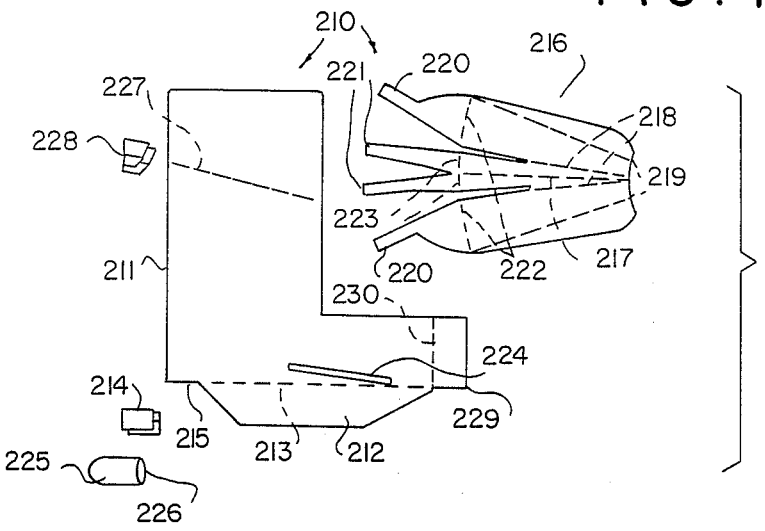
FIG. 8
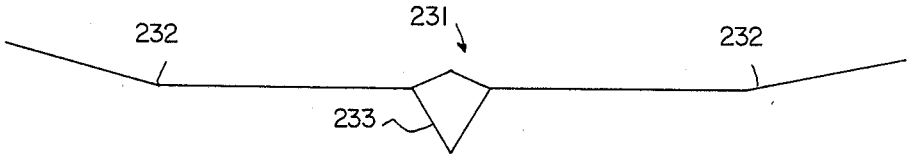
FIG. 9
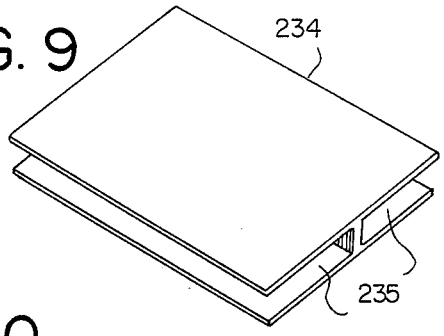
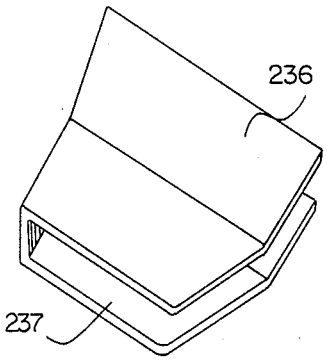
FIG. 10

FIG. 11
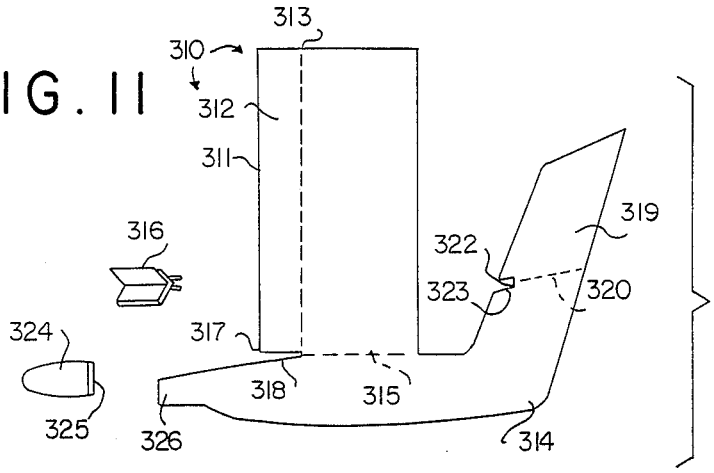
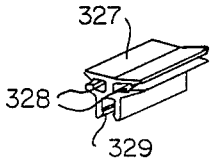
FIG. 12
FIG. 13
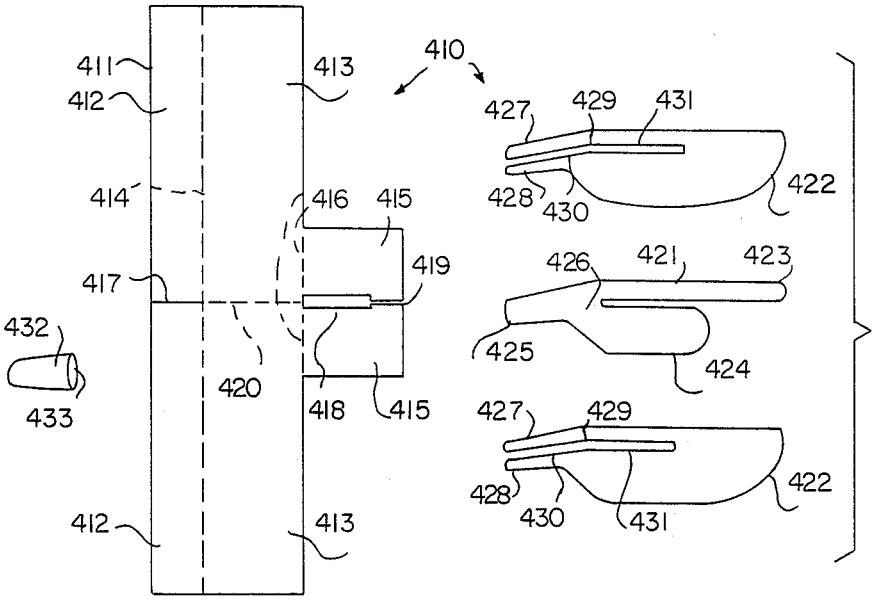

MODEL AIRPLANE OR TOY GLIDER

BACKGROUND OF THE INVENTION

This invention relates to model airplanes and toy gliders which have motion imparted to them by a user's hand or by a launching device such as a catapult or by any other device capable of imparting motion. At least one aspect of the present invention also relates to mechanically or electromechanically remote controlled model airplanes or gliders.

Generally, model airplanes and toy gliders have been constructed to resemble man-made aircraft rather than natural creatures such as birds, butterflies, dragonflies and other airborne living entities.

The model airplanes and toy gliders resembling man-made aircraft employ a variety of flight stabilization means as described in U.S. Pat. No. 4,689,041, issued Oct. 6, 1987 and co-pending application Ser. No. 07/103,954, filed Oct. 2, 1987 for MULTIPLE CONFIGURATION MODEL AIRCRAFT (said patent and application being incorporated herein by reference). Such model aircraft use connector and fuselage connecting means to position flight surfaces in various positions providing different appearances and aerodynamic characteristics.

SUMMARY OF THE INVENTION

A primary object of this invention is to provide novel structure which enables the construction of model airplanes and toy gliders that resemble natural creatures such as birds, butterflies, dragonflies and other airborne entities, as well as model airplanes and toy gliders of other designs, and to provide efficient and stable flight characteristics in a model airplane or toy glider constructed of semi-rigid scoreable and foldable material such as polystyrene foam sheet.

Efficient smoothly curved wing camber is approximated by laterally scoring and folding a material such as polystyrene foam sheet. Efficient flight and low cost manufacturing is facilitated by this lateral scoring arrangement.

Before this time when model airplanes and toy gliders constructed of two wing panels inserted into a joining clip (U.S. Pat. No. 2,739,414; Cleveland) would impact a solid object the wing panels were subject to separating from the clip especially at the rearward portion of the wing panels. It is another object of this invention to provide a model airplane or toy glider in which dihedral and other angles such as wing polyhedral, diffusor fold anhedral, stabilizing or control surface angles or fuselage angles etcetera, are firmly set by angle setting member installed into or on a foldline in scoreable and foldable material such as polystyrene foam sheet.

Another object of this invention is to provide an interlocking wing-fuselage arrangement joined by an appropriately constructed nose part.

Another object of this invention is to provide a "head" shaping, "neck" strengthening hoodlike component of a fuselage capable of being easily manufactured and incorporated into a finished model airplane or toy glider.

A further object of this invention is to provide a realistically and accurately shaped three dimentional whole body fuselage for a model airplane or toy glider resembling a natural creature or of other design which may be screen printed on flat material, die cut and scored, and then folded and incorporated into a finished model airplane or toy glider.

Another object of this invention is to provide diagonally hinged control surfaces on a model airplane or toy glider tail that mimic the actions in turning of the tail on selected natural creatures.

These and other objects of the invention will become more apparent in the following description of the preferred embodiments.

BRIEF DESCRIPTION OF THE DRAWINGS

FIG. 3 is a partially assembled front view of the model airplane or toy glider of FIG. 1 showing the seagull-like angles of the wing portions.

FIG. 4 is an enlarged perspective view of an angle setting member of FIG. 1.

FIG. 5 is an enlarged perspective view with cutaway portions of the hoodlike part of FIG. 1 in assembled condition with respect to the fuselage of FIG. 1.

FIG. 6 is an enlarged perspective view of a modified form of construction of hoodlike part and fuselage.

FIG. 7 is an exploded partial view of another model airplane or toy glider embodying several aspects of the present invention.

FIG. 8 is an external outline front view of the model airplane or toy glider of FIG. 7 showing the polyhedral angles of the assembled wing portions and illustrating the approximate front view shape of the folded fuselage.

FIG. 9 is an enlarged perspective view of the root angle setting member of FIG. 7.

FIG. 10 is an enlarged perspective view of a pinion angle setting member of FIG. 7.

FIG. 11 is an exploded partial view of another model airplane or toy glider embodying aspects of the present invention.

FIG. 12 is an enlarged perspective view of the root angle setting member of FIG. 11.

FIG. 13 is an exploded view of another model airplane or toy glider embodying aspects of the present invention.

DETAILED DESCRIPTION OF THE PREFERRED EMBODIMENTS

A FIRST EMBODIMENT

Figure 1:
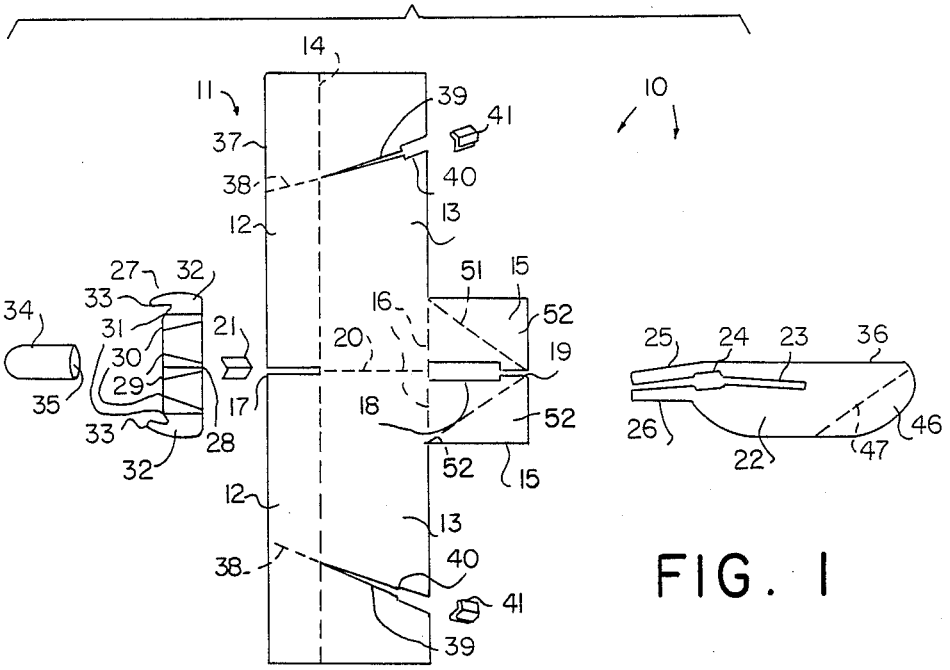
FIG. 1 is an exploded view of a model airplane or toy glider embodying several aspects of the present invention.

Referring to FIG. 1, a model airplane or toy glider 10 made of semi-rigid scoreable and foldable material such as plystyrene foam sheet has a flying wing 11 (some of the illustrated features also may apply to standard or canard arrangements) and is assembled as follows: Leading edge panels 12 are bent down relative to trailing edge panels 13 along lateral score 14, rearward panels 15 are bent up along lateral scores 16. Rearward panels 15 are shown extending rearwardly from the central portion of flying wing 11 and are set off by lateral scores 16, however, rearward panels 15 could be demarcated along a portion of or along the entire length of a straight trailing edge. Flying wing 11 has a forward cut or slot 17 and a rearward slot 18 having a reduced portion 19. Dihedral angle is introduced along longitudinal centerline score 20. Angle setting member 21 is inserted into cut or slot 17, thereby fixing dihedral angle.

Fuselage 22 having a slot 23 with an increased portion 24, increased portion 24 being angled down relative to the rearward portion of slot 23, is rotated 90° upon its longitudinal axis and fuselage tab 25 is inserted through wing slot 18 from underneath wing 11. Fuselage tab 25 continues over installed angle setting member 21 while fuselage tab 26 slides under angle setting member 21. Angle setting member 21 nests into the increased portion 24 of fuselage slot 23. Hood 27 having a score 28, score pairs 29–31, and portions 32 having tabs 33 is folded around forwardly projecting fuselage tabs 25 and 26 (hood installation will be further detailed in FIGS. 4 and 5). Nose weight cap 34 having an opening 35 is slid over fuselage tabs 25 and 26 and hood tabs 33, firmly joining the tabs and locking fuselage 22 in place on wing 11. Reduced portion 19 of rearward wing slot 18 closed when rearward wing panels 15 were bent up and dihedral was introduced. The memory quality of the die stamp compressed polystyrene foam within foldlines 16 results in scores 16 acting as springlike hinges which cause rearward wing panels 15 to rest in upturned position upon fuselage 22 rearward top edge 36 which is vertically higher than fuselage slot 23, and which springlike hinges resist any upward flight-load deflection pressures produced by panels 15.

Wing 11 has diffusor fold scores 38 and rearwardly expanding notches 39 with increased rearwardmost portions 40. Diffusor fold angle is introduced along scores 38 closing rearwardly expanding notches 39. Angle setting members 41 which are structurally the same as angle setting member 21 only inverted, are inserted into increased portions 40, thereby fixing diffusor fold angles.

Rearward wing panels 15 have scores 51 extending from their rearwardmost central point to where wing panels 15 stem from the remaining portion of wing 11 forming control surfaces 52. This arrangement allows mimicry of the appearance and actions in steering or turning of birds and possibly butterflies by means of tail screw action, i.e. one of panels 52 deflected upward and/or one panel 52 deflected downward. This aspect of the invention may especially relate to radio controlled model bird or butterfly airplanes or gliders.

Fuselage 22 additionally has a rudder portion 46 marked by score 47.

Figure 2:
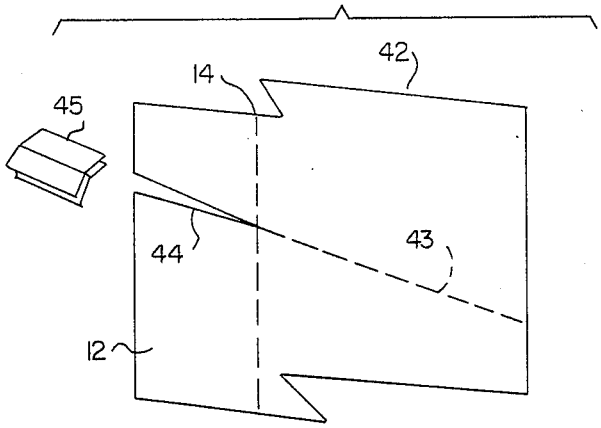
FIG. 2 is a plan view of an alternate pinion fold and angle setting member arrangement to the one shown in FIG. 1.

Referring to FIG. 2 which illustrates an alternate pinion fold and angle setting member arrangement to the one shown in FIG. 1, wing 42 has diffusor fold score 43 and forwardly expanding slot 44. Diffusor fold angle is introduced along score 43, and because leading edge panel 12 is bent downward along score 14, this changes expanding slot 44 into a slot with parallel sides. Angle setting member 45 is inserted into now parallel sided slot 44, thus fixing diffusor fold angle.

Referring to FIG. 3 which illustrates the seagull-like angles of the assembled wing 11 of FIG. 1, the wing 48 is dihedraled from the center point 49 and anhedraled from pinion points 50.

Referring to FIG. 4 which illustrates anyone of the angle setting members 21, 41 or 45 of FIG. 1, the angle setting member **51*a* has a pair of slots 52*a***.

Referring to FIG. 5 which illustrates the installation of hood 27 of FIG. 1, wing 11 not shown, hood 27 is folded over the top of fuselage tab 25. Hood portions 32 with tabs 33 are folded up into the interior of folded hood 27. One hood portion 32 with tab 33 is positioned on each side of fuselage tab 26. A nose weight cap, not shown, such as a rubber pencil cap eraser is inserted into folded hood 27 and over tabs 25,26 and 33 thus joining and locking together wing 11, not shown, hood 27 and fuselage 22. The installed hood 27 strengthens the projecting front portion of fuselage 22 and, in conjunction with a nose weight cap such as a rubber pencil cap eraser, gives a headlike appearance to the assembly.

Referring to FIG. 6 which illustrates an alternative hood/fuselage configuration, hood 127 is folded over the top of fuselage tabs 125 of bi-laminate fuselage 122. Hood portions 132 are folded up into the interior of folded hood 127. The pair of hood portions 132 are positioned inside bi-laminate fuselage bottom half portions 121 and 123. A nose weight cap, not shown, is inserted into folded hood 127 and over fuselage tabs 125 and 126. Illustrated hoods could be used on non-interlocking fuselages.

A SECOND PREFERRED EMBODIMENT

Referring to FIG. 7, a model airplane or toy glider 210 constructed of semi-rigid scoreable and foldable material such as polystyrene foam sheet has two wing halves 211, only one of which is illustrated, and is assembled as follows: Fuselage part 212 is folded down on both wing halves 211 along score 213. Wing halves 211 are brought together along scores 213 and are forwardly joined by inserting angle setting member 214 onto wing edge 215 of both wing halves 211, wing edges 215 forming a slot. Fuselage 216 is folded down along score 217 and scores 218 and folded up along scores 219. Fuselage tabs 220 and 221 are slightly folded down along scores 222 and 223 respectively. Fuselage tabs 220 are inserted through wing slots 224 from the top side of wing 211. Tabs 220 continue under and past installed angle setting member 214, and tabs 221 slide over and past angle setting member 214. Nose weight cap 225, having an opening 226, is slid over forwardly projecting fuselage tabs 220 and 221 firmly joining the tabs and locking three dimentionally folded fuselage 216 in place. Installed fuselage 216 holds together the rearward part of wing halves 211.

Each wing half 211 has a rearwardly converging polyhedral score 227. Polyhedral is introduced and angle setting member 228 is slid over the end of score 227 thus fixing polyhedral fold angle. Elevator 229 is folded up along score 230.

FIG. 8 illustrates the polyhedral angles of the assembled wing 211 of FIG. 7 and the approximate external front view shape of the folded fuselage 216 of FIG. 7. The wing 231 is polyhedraled from pinion points 232. Folded fuselage 233 is positioned on wing 231.

FIG. 9 illustrates the root angle setting member 214 of FIG. 7. Angle setting member 234 has a pair of slots 235.

FIG. 10 illustrates the pinion angle setting member 228 of FIG. 7. Angle setting member 236 has a slot 237.

A THIRD PREFERRED EMBODIMENT

Referring to FIG. 11, a model airplane or toy glider 310 constructed of semi-rigid scoreable and foldable material such as polystyrene foam sheet has two wing halves 311, only one of which is illustrated, and is assembled as follows: Leading edge panel 312 is folded down on both wing halves 311 along score 313. Fuselage part 314 is folded down on both wing halves 311 along score 315. Wing halves 311 are brought together along scores 315 and are forwardly joined by inserting angle setting member 316 onto wing edge 317 and fuselage edge 318 of both wing halves 311. Fuselage edges 318 are angled down relative to scores 315, thus in addition to setting wing dihedral angle, installed angle setting member 316 also fixes the camber angle of leading edge panels 312.

Horizontal stabilizers 319 are bent down along upwardly angled scores 320 and angle setting member 321, similar to angle setting member 316 but not shown, is installed into slots 322 and onto fuselage edges 323. Standard configuration is shown in FIG. 11, canard arrangement is possible. In either arrangement, horizontal stabilizer 319 could also incorporate a lateral score similar is score 313.

Nose weight cap 324 having an opening 325 is slid over Fuselage tabs 326.

FIG. 12 illustrates the angle setting member 316 of FIG. 11. Angle setting member 327 has a pair of slots 328 for receiving leading edge wing panels 312 or elevator panels 319 and a slot 329 for receiving fuselage edges 318 or 323.

A FOURTH PREFERRED EMBODIMENT

Referring to FIG. 13, a model airplane or toy glider 410, generally constructed of semi-rigid scoreable and foldable material such as polystyrene foam sheet, has a wing 411 and a tri-laminate fuselage consisting of internal lamina part 421 and external lamina parts 422, and is assembled as follows: Leading edge panels 412 are bent down relative to trailing edge panels 413 along lateral score 414, rearward panels 415 are bent up along lateral scores 416. Wing 411 has a forward cut or slot 417 and a rearward slot 418 having a reduced portion 419. Dihedral angle is introduced along longitudinal centerline score 420 fractionally opening cut or slot 417 and simultaneously closing rearward slot reduced portion 419. Internal lamina tab 423 is slid over the front portion of wing 411 and through rearward wing slot 418. Internal lamina tab 424 slides under the front portion of wing 411. Internal lamina tab 425 extends forward of the leading edge of wing 411. Angle setting member fuselage portion 426 wedges into fractionally opened cut or slot 417 preventing collapse of dihedral angle. Internal lamina 421 may be constructed of harder material such as cardboard or may be strengthened with suitable tape etcetera in the area of portion 426. Wing 411 may also be strengthened with tape etcetera in the area of cut or slot 417.

External lamina fuselage parts 422 each have a slot 429 with forward part 430 angled down relative to rearward part 431. External lamina fuselage tabs 427 are inserted from underneath the rear of wing slot 418, one on each side of installed internal lamina 421. External lamina fuselage tabs 427 continue over and extend past the leading edge of wing 411. External lamina fuselage tabs 428 slide under wing 411.

Nose weight cap 432, having an opening 433, is slid over forwardly extending fuselage tab 425 and tabs 427 and 428, firmly joining the tabs and locking fuselage lamina 421 and laminae 422 in place on wing 411.

Resistance to compression offered by the top one third portion of the installed fuselage laminae, in conjunction with specific tension and compression relationships of the assembled wing and fuselage, especially with respect to rearward wing slot 418, prevent wing 411 dihedral angle from increasing. Thus, tri-laminate fuselage part 421 and parts 422 are also angle setting members.

FIFTH PREFERRED EMBODIMENTS

Figure 14:
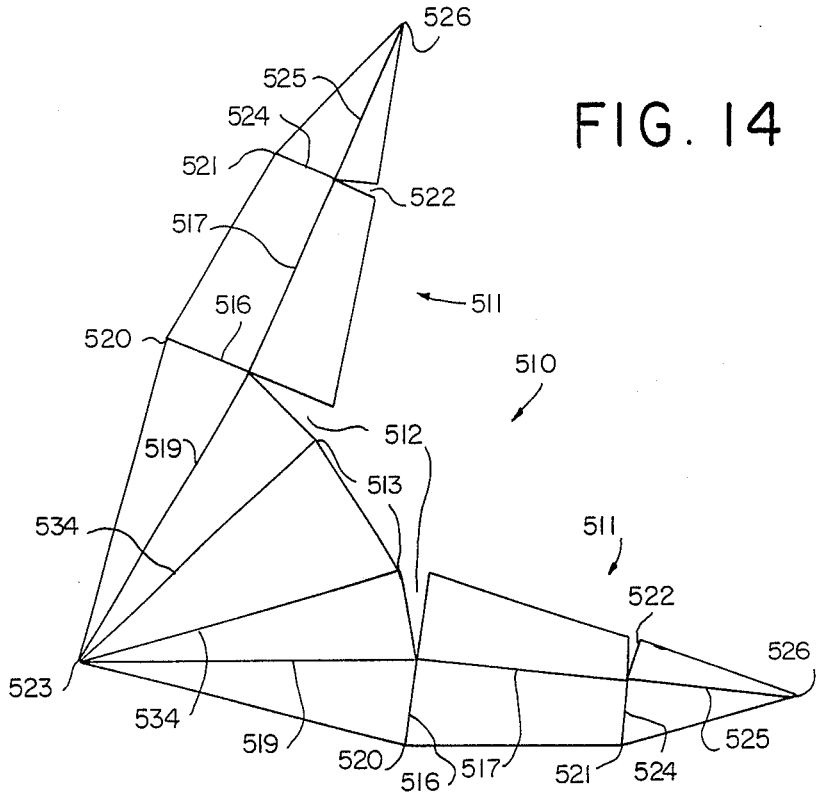
FIG. 14 is a plan view of a complex three dimensional fuselage in unfolded condition.

Referring to FIG. 14, a complex three dimensional fuselage 510 constructed of semi-rigid material such as polystyrene foam sheet is pictured unfolded, is symetrical, is generally V shaped and has two legs 511. Each leg 511 has a V shaped cut 512 and a V shaped cut 522. Scores 516, 517 and 519 extend from the apex of V shaped cut 512. Scores 517, 524 and 525 extend from the apex of V shaped cut 522. Score 516 extends to point 520, score 517 extends from the apex of V shaped cut 512 to the apex of V shaped cut 522 and score 519 extends to point 523. Score 524 extends to point 521 and score 525 to point 526. Score 534 extends from point 513 to point 523.

All scores are folded downward as viewed. V shaped indentations 512 and 522 are closed and held together by tape or by other suitable means and a nose weight such as modeling clay is inserted inside the nose section of folded fuselage 510. The completion of the installation of folded fuselage 510 is similar to the completion of the installation of folded fuselage 610 illustrated in FIG. 17.

Figure 15:
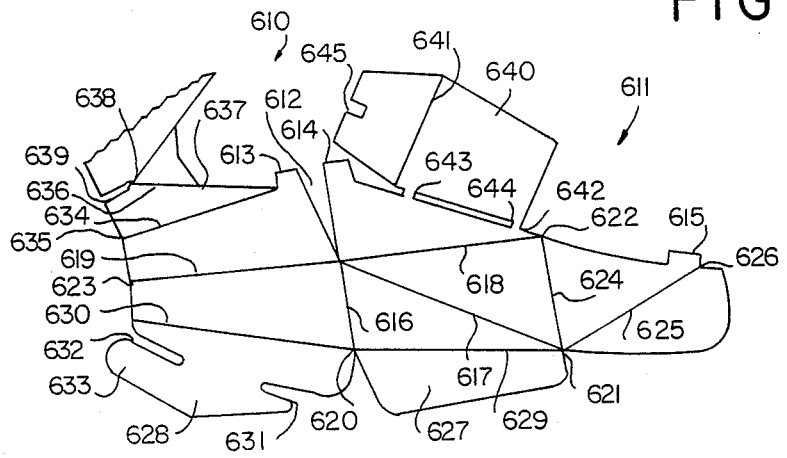
FIG. 15 is a fragmentary plan view of an alternate complex three dimensional fuselage in unfolded condition.

Referring to FIG. 15, a complex three dimensional fuselage 610 constructed of semi-rigid scoreable and foldable material such as polystyrene foam sheet is pictured unfolded, is symetrical, is generally V shaped and has two legs 611. Only one leg is shown.

Each leg 611 has a V shaped cut 612 and tabs 613,614 and 615. Scores 616–619 extend from the apex of V shaped cut 612. Score 616 extends to point 620, score 617 to point 621, score 618 to point 622 and score 619 to point 623. Score 624 extends from point 621 to point 622. Score 625 extends from point 621 to point 626. Tabs 627 and 628 are formed by scores 629 and 630 respectively. Tab 628 has a notch 631, and a notch 632. Notch 632 creates tab 633. Score 634 extends from the base of tab 613 to point 635. Score 636 extends from point 637 to point 638. Notch 639 is located at the forwardmost position along the longitudinal centerline of fuselage 610 forward of point 638. Discrete internal fuselage rib 640 with score 641 and notch 645 is shown removeably attached to fuselage 610 edge 642 via breakable small tabs 643 and 644.

Internal fuselage rib 640 is separated from the remainder of fuselage 610 by breaking small tabs 643 and 644. All scores are folded downward as viewed except score 625 which is folded in the opposite direction. Tabs 627 and 628 are hard folded up into the interior of the now roughly cylindrically folded fuselage 610 (see FIG. 17). Discrete internal rib 640 is placed in horizontal position and forward notch 645 is inserted into notches 631 on now internal tabs 628 thereby loosely holding together the middle portion of folded fuselage 610.

Figure 17:
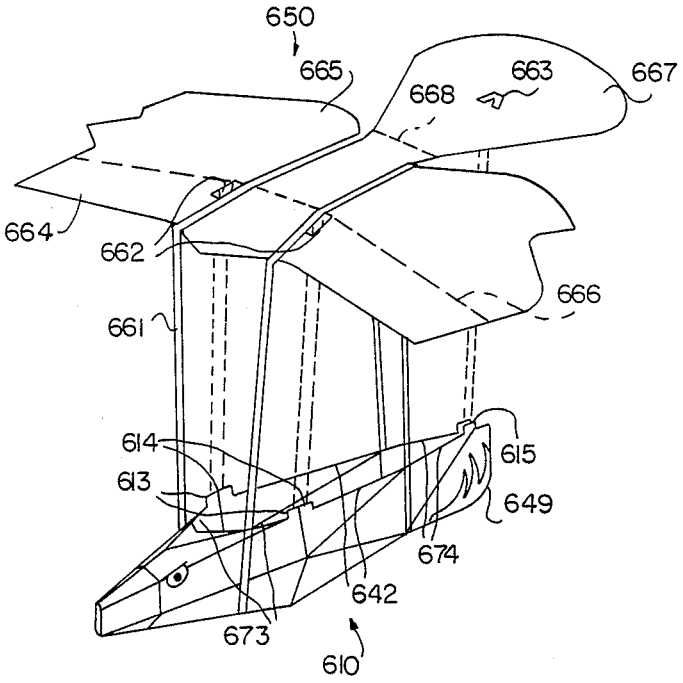
FIG. 17 is a partially exploded fragmentary perspective view of a model airplane or toy glider incorporating the fuselage of FIG. 15 and other aspects of the present invention, including assemblage via elastic band.

A nose weight cap, not shown, such as a rubber pencil cap eraser is inserted into the now hexigonal front opening of folded fuselage 610 and over internal tabs 633 thus holding together the front end portion of folded fuselage 610. The completion of the installation of folded fuselage 610 is illustrated in FIG. 17.

Figure 16:
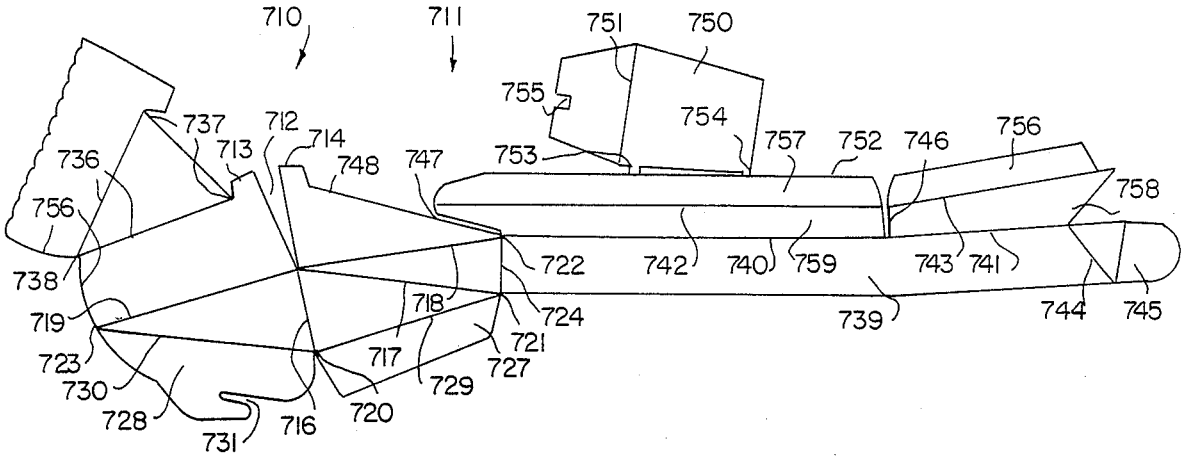
FIG. 16 is a fragmentary plan view of another alternate complex three dimensional fuselage in unfolded condition.

Referring to FIG. 16, an alternate complex three dimensional fuselage 710 for a dragonfly model airplane or toy glider is similar to the fuselage illustrated in FIG. 15. Each leg 711 has a V shaped cut 712 and tabs 713 and 714. Additional V shaped cuts are not pictured but could be incorporated forward or rearward of V shaped cut 712. Scores 716–719 extend from the apex of V shaped cut 712. Score 716 extends to point 720, score 717 to point 721, score 718 to point 722 and score 719 to point 723. Score 724 extends from point 721 to point 722. Tabs 727 and 728 are formed by scores 729 and 730 respectively. Tab 728 has a notch 731. Score 736 extends from point 737 to longitudinal centerline forwardmost point 738.

Each leg 711 has an elongated rearwardly extending portion 739. Rearwardly extending portion 739 has scores 740–745 and cut 746. Cut 747 is located along edge 748. Discrete internal fuselage rib 750 with score 751 and notch 755 is shown removeably attached to fuselage 710 edge 752 via breakable small tabs 753 and 754.

Internal fuselage rib 750 is separated from the remainder of fuselage 710 by breaking small tabs 753 and 754. All scores are folded downward as viewed except scores 724 and 745 which are folded in the opposite direction. Tabs 727 and 728 are hard folded up into the interior of the now roughly cylindrically folded fuselage 710. Discrete internal rib 750 is placed in horizontal position and forward notch 755 is inserted into notches 731 on now internal tabs 728 thereby loosely holding together the middle portion of folded fuselage 710.

Rearward tabs 756 and 757 are folded down into the interior of rearwardly extending portion 739. A small elastic band, not shown, is placed around the fuselage portion extending rearward from cut 746 thus firmly holding tabs 756 down into the interior of folded fuselage 710 and fixing a generally triangular cross sectional shape to the rearwardly extending portion 739. Tabs 758 and 759 form the horizontal top surface of the now generally triangular rearwardly extending portion 739 of fuselage 710. A nose weight, not shown, in the form of large dragonfly eyes is attached by suitable means to the forward portion of fuselage 710. The completion of the installation of folded fuselage 710 is similar to the completion of the installation of folded fuselage 610 illustrated in FIG. 17.

Referring to FIG. 17, the model airplane or toy glider complex three dimentional fuselage 610 of FIG. 15, now folded, is to be mated with wing 650 via elastic band 661. Elastic band 661 is pictorially shown greatly expanded. Fuselage tabs 613 and 614 insert into slots 662. Tabs 615 insert into slot 663.

Wing leading edge panel 664 is bent down relative to trailing edge panel 665 along lateral score 666, rearward panel 667 is bent up along score 668. Fuselage 610 has edges 642,673 and 674, the horizontal angles of which correspond to the desired horizontal angles of wing leading edge panel 664, wing trailing edge panel 665 and rearward panel 667 respectively. Fuselage panels 649, one visible, are moveable "talon" rudders.

It is understood that the described preferred embodiments are merely illustrative of some of the many specific embodiments which represent applications and principals of the present invention. Clearly, numerous and varied other arrangements may be devised by those skilled in the art without departing from the spirit and scope of the invention.

I claim:

1. A toy glider comprising:

a wing having leading and trailing edges and formed of a semi-rigid, scoreable and foldable material, said wing having a first score line on the longitudinal centerline thereof and a second score line extending transversely across the length of said wing at approximately one third the distance from said leading edge, said second score line dividing said wing into leading edge and trailing edge panels, said leading edge panel having a slot extending inwardly from the leading edge thereof on the longitudinal centerline of said wing to said second score line;

an angle setting member insertable into the slot of said leading edge panel for engaging the portions of said leading panel on opposite sides of the slot to establish the dihedral angle thereof; and a fuselage formed of a semi-rigid, scoreable and foldable material, said fuselage having a body portion with a leading edge and a trailing edge, said body portion having a slot extending rearwardly from the leading edge thereof, the slot having an entry portion, a central portion and an inner portion, the width of the inner portion being substantially equal to the thickness of said material forming said wing, the central portion being of sufficiently greater width as to accommodate said angle setting member, said entry and central portions being angled relative to the inner portion whereby, in the assembled configuration of said glider, said leading edge panel of said wing is angled downwardly relative to said trailing edge panel.

2. The toy glider of claim 1 further including a hood receivable on said fuselage forwardly of said wing, said hood being formed of a semi-rigid, scoreable and foldable material.

3. The toy glider of claim 2 wherein said wing further includes a pair of rearward panels extending from said trailing edge panel, said rearward panels being symmetric about the longitudinal centerline of said wing and separated from one another by a slot, each said rearward panel having a score line extending diagonally thereacross from a point adjacent said slot at the rearward edge of said rearward panel and a score line extending along the line of juncture between said trailing edge panel and said rearward panel.

4. The toy glider of claim 1 wherein said wing further includes a pair of rearward panels extending from said trailing edge panel, said rearward panels being symmetric about the longitudinal centerline of said wing and separated from one another by a slot, each said rearward panel having a score line extending diagonally thereacross from a point adjacent said slot at the rearward edge of said rearward panel and a score line extending along the line of juncture between said trailing edge panel and said rearward panel.

* * * * *